US005231761A

United States Patent [19]

Heintke et al.

[11] Patent Number: 5,231,761

[45] Date of Patent: Aug. 3, 1993

[54] HINGED FRAMES FOR A DRY SHAVING APPARATUS

[75] Inventors: Hans-Eberhard Heintke, Wächtersbach, Fed. Rep. of Germany; Robert White, Cholsey, Great Britain

[73] Assignee: Braun Aktiengesellschaft, Frankfurt, Fed. Rep. of Germany

[21] Appl. No.: 777,372

[22] PCT Filed: May 21, 1990

[86] PCT No.: PCT/DE90/00522

§ 371 Date: Nov. 22, 1991

§ 102(e) Date: Nov. 22, 1991

[87] PCT Pub. No.: WO90/14933

PCT Pub. Date: Dec. 13, 1990

[30] Foreign Application Priority Data

Jun. 1, 1989 [DE] Fed. Rep. of Germany ..... 3917849

[51] Int. Cl.[5] ..... B26B 19/02

[52] U.S. Cl. ..... 30/43.92

[58] Field of Search ..... 30/43.91, 43.92, 43.9, 30/43.1, 43.2, 50, 89

[56] References Cited

U.S. PATENT DOCUMENTS

| | | | |
|---|---|---|---|
| 4,660,283 | 4/1987 | Yasunaka | 30/43.92 |
| 4,760,297 | 7/1988 | Schemmann et al. | 30/43.92 |
| 4,796,359 | 1/1989 | Oprach et al. | 30/43.92 |
| 4,797,997 | 1/1989 | Packham et al. | 30/43.92 |
| 4,825,542 | 5/1989 | Locke | 30/43.92 |

FOREIGN PATENT DOCUMENTS

| | | |
|---|---|---|
| 0267044 | 5/1988 | European Pat. Off. . |
| 2036631 | 12/1979 | United Kingdom . |

*Primary Examiner*—Frank T. Yost
*Assistant Examiner*—Paul M. Heyrana, Sr.
*Attorney, Agent, or Firm*—Fish & Richardson

[57] ABSTRACT

The invention is directed to a twin-head shaver comprising a first hinged frame arranged in the shaving head frame and carrying the upper cutters for control of a vertical movement of the upper cutters relative to and parallel with each other, and a second hinged frame for sequential control of the lower cutters operatively associated with the upper cutters.

16 Claims, 4 Drawing Sheets

HINGED FRAMES FOR A DRY SHAVING APPARATUS

This invention relates to a dry shaving apparatus comprising a drive mechanism arranged in a housing, a shaving head frame mounted on the housing, a pair of shaving heads extending in longitudinal direction parallel with each other and including each an upper cutter and a lower cutter and being movable vertically relative to and parallel with each other, a first hinged frame mounted in the shaving head frame and carrying the upper cutters for control of the relative movement of the upper cutters, and a second hinged frame carrying the lower cutters and coupled to a drive member of the drive mechanism, in which the second hinged frame is comprised of a frame coupled to the drive member so as to be pivotal about the longitudinal axis x—x as well as of two mounting members coupled to the frame by means of pivot joints and being movable relative to and parallel with each other.

A dry shaving apparatus of the type initially referred to is known from EP-A-0 267 044. The hinged frame assembly arranged outside the housing intermediate the drive arm and the two inner cutters is comprised of a drive block pivotally mounted on the drive arm transversely to the longitudinal axis of the inner cutters and having a recess extending parallel to the longitudinal axis of the inner cutters, of a rigid mounting frame pivotally carried in this recess and having two pins arranged at its respective outer ends, and of a pair of U-shaped, parallel yoke members whose legs are provided with bores at their respective ends for pivotally receiving the pins on the rigid frame. Secured to the upper side of each U-shaped yoke member is an inner cutter carried by a double cantilever spring.

It is an object of the present invention to provide, for a shaving apparatus of the type initially referred to, a control arrangement for the two elongate lower cutters by means of which the guiding of the lower cutters in vertical direction is improved.

According to the invention, this requirement is satisfied in an apparatus of the type initially referred to in that a connecting member is arranged intermediate the mounting members, and a hinge joint exists between the connecting member and the respective mounting member.

The configuration and mounting of the second hinged frame on the drive member extending out of the housing of the dry shaving apparatus ensures an exact parallel coupling and alignment of the two lower cutters on the associated mounting members of the second hinged frame, as well as an exact parallel movement of the two lower cutters relative to each other in vertical direction, in addition to ensuring a linear oscillating movement in horizontal direction. Accordingly, the two lower cutters are linearly driven via the vertically movable mounting members of the second hinged frame, while their parallel relationship is maintained. The coupling of the lower cutters by the second hinged frame facilitates the removal of the shaving head frame equipped with upper cutters vertically movable relative to each other from the shaver housing and its replacement.

In an embodiment of the invention, the pivot joints are formed of mounting bores provided in the respective end walls of the mounting members and of mounting pins provided on the frame for engagement in these bores. Preferably, the hinge joint between the connecting member and the respective mounting member is formed by film hinges.

In accordance with the invention, the one pivot joints as well as the one hinge joint between the mounting member and the connecting member are disposed on a common vertical axis y—y, and the other pivot joints as well as the other hinge joint between the mounting member and the connecting member are disposed on a common vertical axis z—z extending parallel to the axis y—y.

Conveniently, the drive member is coupled to the frame by means of two pivot joints. The pivot joints are preferably formed of balls carried in the respective ends of the drive member and of bearing sockets formed in the insides of the respective end walls of the frame. To enable the second hinged frame to be readily coupled to, and decoupled from, the drive member, at least one of the balls is acted upon by a spring disposed in the drive member.

In accordance with the invention, the mounting pins are arranged on the frame in opposite pairs, projecting beyond the respective outsides of the end walls of the frame. In a suitable embodiment of the invention, an isosceles triangle is formed by the arrangement and the relative distance of the respective bearing socket to the respective pair of mounting pins.

In an embodiment of the invention, the connecting member is arranged at the ends of the mounting members close to the lower cutters and is separated from the end walls of the mounting members by a slot.

To accomplish an unimpeded movement of the mounting members movable relative to and parallel with each other and of the coupling arms formed thereon, a rectangular recess is formed in the respective longitudinal side walls of the connecting member.

Preferably, each mounting member has formed on it a vertically extending coupling arm lying on the respective axis y—y and z—z.

An embodiment of the present invention will be disclosed in the following description and the accompanying drawings, in which.

Figure 1:
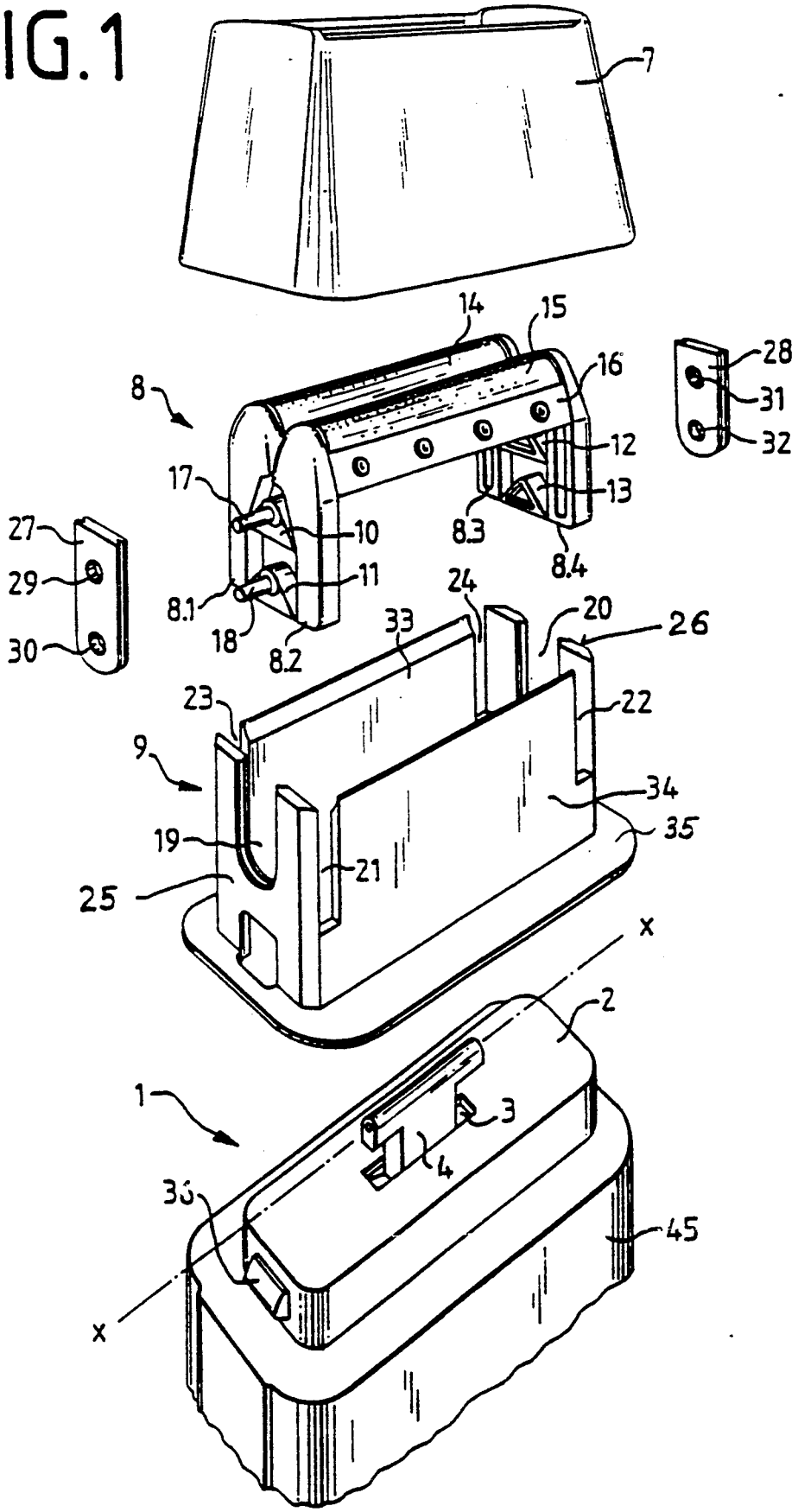
FIG. 1 is an exploded view showing a shaving head frame adapted to be seated on a housing.

In the exploded view of FIG. 1, the housing, only shown in part, of a dry shaving apparatus is identified by reference numeral 1, the drive member extending out of the opening 3 of the upper housing portion 2 is assigned reference numeral 4, and the shaving head frame, the first hinged frame and the auxiliary frame carry the reference numerals 7, 8 and 9, respectively. The two opposite ends of the first hinged frame 8 comprise each a pair of end walls 8.1, 8.2 and 8.3, 8.4 which are pivotally connected with each other by a respective pair of transverse link members 10, 11 and 12, 13, for example, by means of film hinges. The end walls 8.1 and 8.3 are connected with each other by two horizontally extending side walls (not shown) to which a shaving foil 14 of arched form is attached. The end walls 8.2 and 8.4 are likewise connected with each other by two horizontally extending side walls to which a shaving foil 15 of arched form is attached and of which the side wall identified by reference numeral 16 is shown. Each transverse link member 10, 11, 12 and 13 has at its respective end a mounting pin of which the mounting pins 17, 18 provided on the transverse link members 10 and 11, respectively, are illustrated in the drawing. The mounting pins 17 and 18 lie on a common vertical axis and combine with the film hinge joints of the respective transverse link members 10 and 12 to form an isosceles triangle. The end, not shown, of the first hinged frame is identical in construction with the end shown.

In the embodiment of the shaving head frame 7 shown in FIG. 1, the auxiliary frame 9 serves the function of mounting and fastening the first hinged frame 8 in the shaving head frame. The auxiliary frame 9 is provided with six vertical recesses 19 to 24. The recesses 19 and 20 formed in the respective end walls 25 and 26 serve to mount the first hinged frame 8 by means of correspondingly formed mounting plates 27 and 28 having each two mounting bores 29, 30 and 31, 32, respectively, to receive the mounting pins provided on the transverse link members 10, 11 and 12, 13, respectively. With the hinged frame 8 and the auxiliary frame 9 in assembled condition, the end walls 8.1 to 8.4 slide within the respective recesses 21 to 24 provided in the respective longitudinal side walls 33 and 34 in vertical direction relative to and parallel with each other, constrained by the guiding of the transverse link members 10 to 13 pivotally carried by means of their mounting pins in the respective bores 29 to 32 of the respective mounting plates 27 and 28. In assembled condition, the hinged frame 8 and the auxiliary frame 9 are inserted in the shaving head frame 7 from below until abutment with the circumferential molding 35 provided on the auxiliary frame 9, and are held therein by frictional engagement means, for example, or by other fastening means. A locking element 36 provided in the wall of the housing 1 cooperates with a locking groove (not shown) provided in the shaving head frame 7 to secure the shaving head frame 7 to the housing 1.

Figure 2:
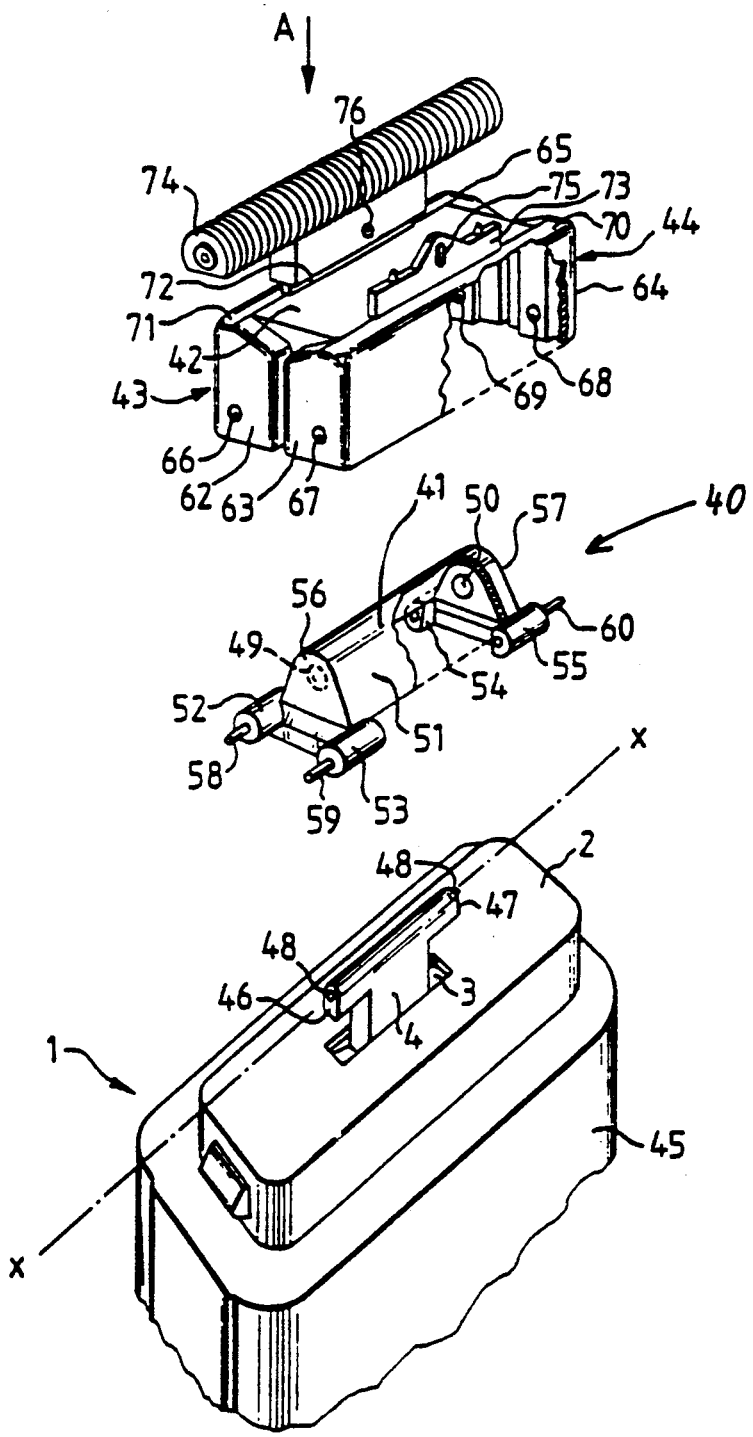
FIG. 2 is an exploded view showing the upper part of a housing with a second hinged frame and a lower cutter.

FIG. 2 shows the upper part of the housing 1 as well as the second hinged frame 40 which is comprised of the frame 41 and the mounting members 43 and 44 coupled together by means of a connecting member 42.

The housing 1 is composed of an outer shell 45 surrounding the electric drive mechanism. The upper end 2 of the housing includes an elongate opening 3 through which the linearly oscillating drive member 4 of the electric drive mechanism extends, surrounded by a seal not shown. The drive member 4 is shaped in the manner of a T.

Figure 3:
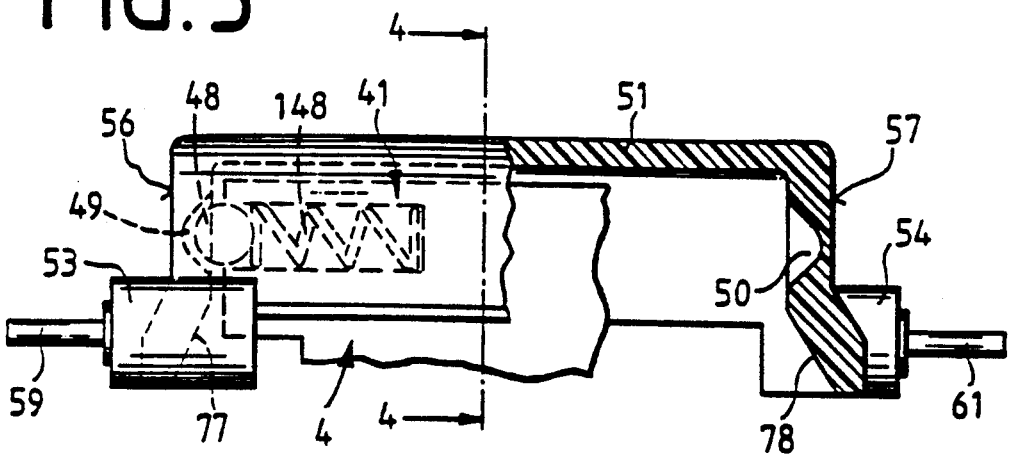
FIG. 3 is a side view showing the frame and drive member partly sectioned.

Lying on the longitudinal axis x—x extending through the horizontal arm of the drive member, a ball 48 is arranged in the respective ends 46, 47 of the arm, the balls pivotally carrying the frame 41 in which the bearing sockets 49, 50 are provided—see FIG. 3—on the drive member 4 transversely to the longitudinal axis x—x. To facilitate the mounting and dismounting of the frame 41 on and from the drive member 4, at least one of the balls 48 is arranged to be displaceable into the horizontal arm against the pressure of a spring 148 (FIG. 3). Bearing pins having a spherical end may be arranged in the horizontal arm to replace the balls 48.

The frame 41 of FIGS. 2 and 3 is comprised of a parabolic body 51 having mounting lugs 52 to 55 formed on the body walls extending parallel to the longitudinal axis x—x, such that the lugs protrude beyond the respective end walls 56, 57 of the frame 41. Mounting pins 58 to 61 projecting from the respective mounting lugs 52 to 55 are secured inside the respective lugs for the purpose of forming pivot joints with respective mounting bores 66 to 69 provided in the respective end walls 62 to 65 of the mounting members 43 and 44. On the side walls 70 and 71 of the mounting members 43, 44 remote from the upper side 2 of the housing, respective coupling arms 72, 73 are formed for fastening the two lower cutters 74 of which only one is shown in FIG. 2. The lower cutters 74 are vertically movably carried on the respective coupling arms 72, 73 against the pressure of a spring (not shown in the drawing) by means of a pin 76 slidable in a vertical slot 75.

FIG. 3 illustrates the frame 41 with a portion partly broken away, thus showing the mounting lug 53 provided on the wall of the body 51 in a manner protruding from the end wall 56, together with the mounting pin 59 secured in the lug at the one end, as well as the mounting lug 54 formed on the opposite wall of the body 51 in a manner protruding from the end wall 57, together with the mounting pin 61 secured in the lug at the other end. The bearing sockets 49 and 50 formed on the inside of the respective end walls 56, 57 are of convex form to receive the balls 48 provided on the drive member 4. To facilitate the introduction of the balls 48 in the respective bearing sockets, the respective end walls 56, 57 are arranged to extend at an outward angle. This provides tapering sliding walls 77, 78 enabling the balls 48 to be threaded into the respective bearing sockets 49, 50.

Figure 4:
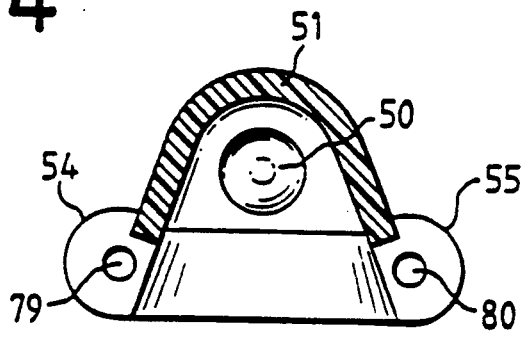
FIG. 4 is a cross sectional view through the frame.

FIG. 4 shows a section through the frame 41 taken on the line A-A. Formed on the wall of the body 51 are the adjacent mounting lugs 54, 55 having respective bores 79, 80 to receive the respective mounting pins 60 and 61 shown in FIGS. 2 and 3. In addition, the bearing socket 50 formed on the inside of the end wall 57 and the sliding wall 78 are also illustrated.

Figure 5:
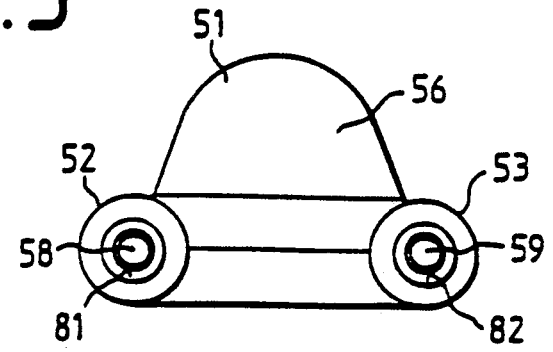
FIG. 5 is a view showing one of the ends of the frame.

FIG. 5 shows a view of the end wall 56, with adjacent mounting lugs 52, 53 formed on the wall of the body 51 and with respective bores 81, 82 provided in the mounting lugs for receiving the respective mounting pins 58, 59.

Figure 6:
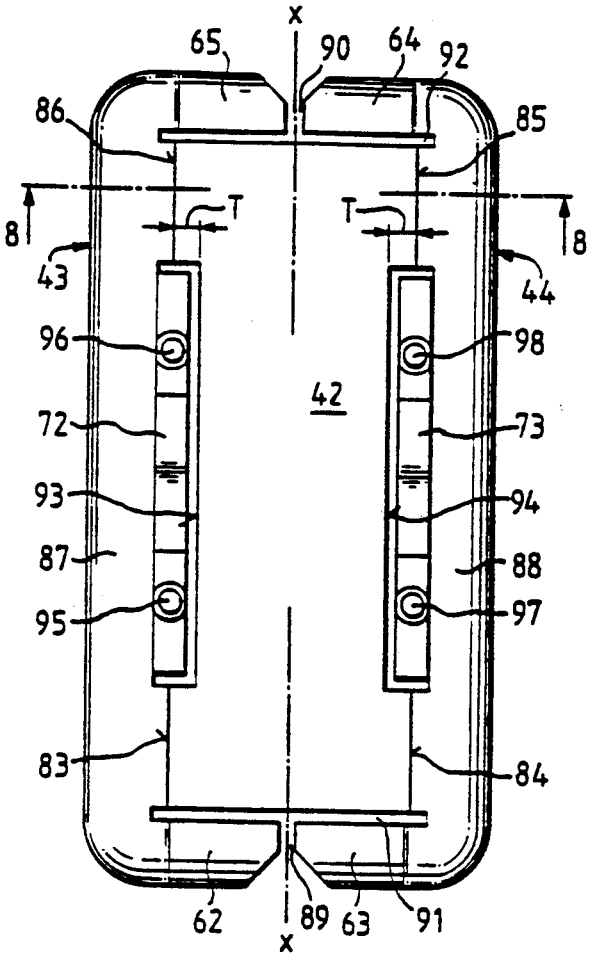
FIG. 6 is a top plan view showing the connecting member with the mounting members pivoted thereto.

FIG. 6 shows a view—in the direction of the arrow A of FIG. 2—of the connecting member 42 and the mounting members 43, 44 pivotally connected to its longitudinal sides by means of a hinge joint comprised of film hinges 83 to 86. The mounting members 43, 44 include each a respective side wall 87, 88 extending parallel to the longitudinal axis and respective end walls 62, 65 and 63, 64 formed at the respective ends of the side walls 87, 88 at right angles to the longitudinal axis x—x. To enable the mounting members 43, 44 to move relative to each other, the end walls 62 and 63 are separated by a slot 89, the end walls 64 and 65 are separated by a slot 90, and the connecting member 42 is at its one end separated from the end walls 62 and 63 by a slot 91 and at its other end separated from the end walls 64 and 65 by a slot 92. The film hinges 83, 86 and 84, 85 are separated from each other by respective rectangular recesses 93 and 94 formed in the connecting member 42. The depth T of the recesses 93 and 94 is dimensioned such that the respective coupling arms 72 and 73 formed on the respective mounting members 43 and 44 and extending into the respective recesses 93 and 94 are free to follow the vertical relative movement of the mounting members 43, 44. Formed on the upper side of the coupling arms 72 and 73 are two respective cylindrical bolts 95, 96 and 97, 98, respectively, for the purpose of holding springs (not shown) acting on the respective lower cutters 74.

Figure 7:
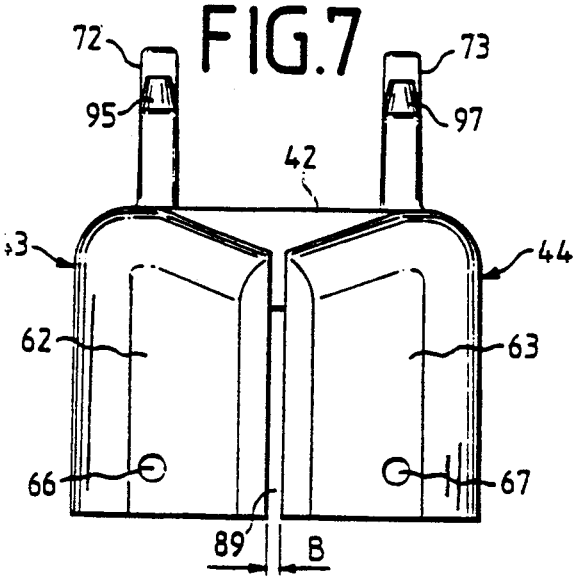
FIG. 7 is a side view showing the ends of the mounting members with coupling arms.

FIG. 7 shows a view of the end walls 62 and 63 of the mounting members 43, 44. The end walls 62 and 63 are separated from each other by the vertical slot 89 whose width B is dimensioned such that the mounting members 43, 44 are free to move vertically relative to each other.

Figure 8:
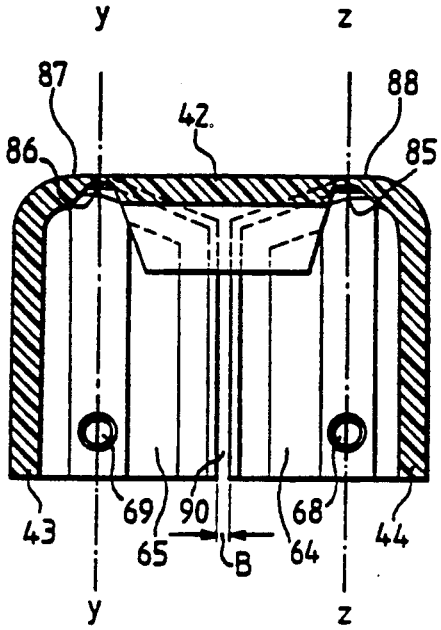
FIG. 8 is a cross sectional view of the mounting members, the coupling arms and the connecting member taken along the line B—B of FIG. 6.

FIG. 8 shows a section through the mounting members 43 and 44 and through the connecting member 42, taken along the line B-B of FIG. 6. For the purpose of providing a four-bar mounting linkage, the mounting bore 69 disposed in the end wall 65 and the film hinge 86 connecting the mounting member 43 with the connecting member 42 lie on a vertical axis y—y, while the mounting bore 68 disposed in the end wall 64 and the film hinge 85 connecting the mounting member 44 with the connecting member 42 lie on a vertical axis z—z parallel with the vertical axis y—y. The vertical axis y—y extends through the coupling arm 72 formed on the mounting member 43, and the vertical axis z—z extends through the coupling arm 73 formed on the mounting member 44.

By virtue of the film hinges connecting the connecting member 42 with the mounting members 43 and 44, a container-like structure is obtained which can be manufactured as a unitary plastics moulding and which, following its assembly with the frame 41, ensures a vertical movement of the mounting members 43 and 44 relative to and parallel with each other due to the pivot joints provided by the mounting bores 66 to 69 and the mounting pins 58 to 61, including the pivotal mounting of the frame 41 on the drive member 4 about the longitudinal axis x—x.

We claim:

1. A dry shaving apparatus comprising housing structure, a drive mechanism arranged in said housing structure, said drive mechanism including a drive member, a shaving head frame mounted on said housing structure, a pair of shaving heads extending in longitudinal direction parallel with each other, each said shaving head including an upper cutter and a lower cutter and being movable vertically relative to and parallel with each other, a first assembly mounted in said shaving head frame and carrying said upper cutters for control of the relative movement of said upper cutters vertically relative to and parallel with each other, and a second assembly carrying said lower cutters and coupled to said drive member, said second assembly including coupling structure connected to said drive member for pivotal movement about a longitudinal axis x—x parallel to said shaving heads, said coupling structure including pivot joint structure, two mounting members connected to said coupling structure by said pivot joint structure for movement movable relative to and parallel with each other, each said mounting member having a said lower cutter mounted thereon, a connecting member for interconnecting said mounting members, and hinge joint structure between said connecting member and each said mounting member.

2. The dry shaving apparatus of claim 1 wherein each said mounting member has two spaced end walls, and said pivot joint structure includes mounting bores in said end walls of said mounting members and mounting pins on said coupling structure for engagement in said bores.

3. The dry shaving apparatus of claim 2 wherein said drive member is connected to said coupling structure by means of two pivot joints.

4. The dry shaving apparatus of claim 3 wherein said coupling structure has spaced end walls, and each said pivot joint is formed of a ball carried in a respective end of said drive member and a bearing socket formed in the inside of a respective end wall of said coupling structure.

5. The dry shaving apparatus of claim 4 wherein at least one of said balls is acted upon by a spring disposed in said drive member.

6. The dry shaving apparatus of claim 4 wherein an isosceles triangle is formed by the arrangement and the relative distance of the respective bearing socket to the respective pair of said mounting pins.

7. The dry shaving apparatus of claim 2 wherein said mounting pins are arranged on said coupling structure in opposed pairs, and project beyond the respective outsides of said end walls of said coupling structure.

8. The dry shaving apparatus of claim 2 wherein said connecting member is at the upper sides of said mounting members close to said lower cutters and is separated from said end walls of said mounting members by slots.

9. The dry shaving apparatus of claim 8 wherein said mounting members and said connecting member are portions of a unitary plastics molding, said hinge joint structure between said connecting member and the respective mounting members are plastic film hinges, and rectangular recesses are formed in respective longitudinal side walls of said connecting member between said film hinges.

10. The dry shaving apparatus of claim 1 wherein said hinge joint structure between said connecting member and the respective mounting members are film hinges.

11. The dry shaving apparatus as claimed in claim 10 wherein each said mounting member has two spaced end walls, said pivot joint structure includes mounting bores in said end walls of said mounting members and mounting pins on said coupling structure for engagement in said bores, said mounting pins are arranged on said coupling structure in opposite pairs and projecting beyond the respective outsides of said end walls of said coupling structure.

12. The dry shaving apparatus as claimed in claim 11 wherein an isosceles triangle is formed by the arrangement and the relative distance of the respective bearing socket to the respective pair of mounting pins.

13. The dry shaving apparatus of claim 12 wherein one said pivot joint structure and one said hinge joint structure between said mounting member and said connecting member are disposed on a common vertical axis y—y, and another said pivot joint structure and another said hinge joint structure between said mounting member and said connecting member are disposed on a common vertical axis z—z extending parallel to said axis y—y.

14. The dry shaving apparatus of claim 13 wherein each said mounting member has an integral vertically extending coupling arm lying on the respective axis x—x and y—y and a said lower cutter is mounted on each said coupling arm.

15. The dry shaving apparatus of claim 1 wherein one said pivot joint structure and one said hinge joint structure between said mounting member and said connecting member are disposed on a common vertical axis y—y, and another said pivot joint structure and another said hinge joint structure between said mounting member and said connecting member are disposed on a common vertical axis z—z extending parallel to said axis y—y.

16. The dry shaving apparatus of claim 1 or claim 2 wherein each said mounting member has formed on it a vertically extending coupling arm lying on the respective axis x—x and y—y and a said lower cutter is mounted on each said coupling arm.

* * * * *